United States Patent [19]

Wicks

[11] Patent Number: 4,555,321

[45] Date of Patent: Nov. 26, 1985

[54] SELECTIVE PLATING APPARATUS

[75] Inventor: John L. Wicks, Mechanicsburg, Pa.

[73] Assignee: AMP Incorporated, Harrisburg, Pa.

[21] Appl. No.: 618,707

[22] Filed: Jun. 8, 1984

[51] Int. Cl.[4] ..... C25D 5/02; C25D 17/00

[52] U.S. Cl. ..... 204/224 R; 204/15; 204/26; 204/225

[58] Field of Search ..... 204/26, 224 R, 225

[56] References Cited

U.S. PATENT DOCUMENTS

| | | | |
|---|---|---|---|
| 2,448,117 | 8/1948 | Pearson et al. | 204/225 |
| 2,477,808 | 8/1949 | Jones | 204/225 |
| 2,503,863 | 4/1950 | Bart | 204/225 |
| 3,410,781 | 11/1968 | Carlson | 204/225 |
| 3,951,761 | 4/1976 | Göhringer et al. | 204/15 |
| 4,340,449 | 7/1982 | Srinivasan | 204/224 R |
| 4,364,801 | 12/1982 | Salama | 204/224 R |
| 4,384,926 | 5/1983 | Wagner | 204/26 |
| 4,427,498 | 1/1984 | Wagner | 204/224 R |

*Primary Examiner*—Arthur P. Demers
*Attorney, Agent, or Firm*—Katherine A. Nelson

[57] ABSTRACT

An improved apparatus for plating interior surfaces of electrical terminals that are spaced apart and attached to a carrier strip is disclosed. The apparatus is comprised of strip feeding means which feeds the strip of terminals to a rotating mandrel which guides the terminals through a plating zone while they are plated, a source of electrolytic plating solution, and a source of electrical potential for applying electrical current flow from an anode through the solution to a cathode. The mandrel has a plurality of anode extensions located about its axis of rotation, said anode extensions being movable into and out of the interiors of the terminals that are against the mandrel. The mandrel further has a plurality of nozzles located about its axis of rotation, said nozzle being associated with but separate from said anode extensions. A conduit supplies electrolyte solution under pressure through the nozzles and into the terminals in which the associated anode extensions have been received, the anode extensions being constructed for withdrawal from the terminals prior to those terminals exiting from the mandrel.

7 Claims, 7 Drawing Figures

SELECTIVE PLATING APPARATUS

FIELD OF THE INVENTION

The present invention relates to selective plating, i.e., electroplating selectively only the electrical contact surfaces of electrical terminals to the exclusion of other surfaces of the terminals and, in particular, terminals that are attached to a carrier strip.

BACKGROUND OF THE INVENTION

In one method of manufacturing electrical terminals, the terminals are stamped and formed from metal strip and are attached to a carrier strip. This carrier strip is useful for strip feeding the terminals through successive manufacturing operations. One necessary manufacturing operation involves plating, i.e., electroplating the electrical contact surfaces of the strip fed terminals with a contact metal, usually noble metals or noble metal alloys. These metals are characterized by good electrical conductivity and little or no formation of oxides that reduce the conductivity. Therefore, these metals, when applied as plating, will enhance conductivity of the terminals. The high cost of these metals has necessitated precision deposition on the contact surfaces of the terminals, and not on surfaces of the terminals on which plating is unnecessary.

Apparatus for plating is called a plating cell and includes an electrical anode, an electrical cathode comprised of the strip fed terminals, and a plating solution, i.e., an electrolyte of metal ions. A strip feeding means feeds the strip to a strip guide. The strip guide guides the terminals through a plating zone while the terminals are being plated. The plating solution is fluidic and is placed in contact with the anode and the terminals. The apparatus operates by passing electrical current from the anode through the plating solution to the terminals. The metal ions deposit as metal plating on those terminal surfaces in contact with the plating solution.

There are disclosed in U.S. Pat. No. 4,384,926 and 4,427,498, owned by this assignee, plating apparati in which the interior surfaces of strip fed terminals can be plated by supplying plating fluid through nozzles and over anode extensions that are mounted for reciprocation into and out of the interiors of terminals, said anode extensions being mounted within said nozzles.

The present invention is directed to an improved apparatus of the general type disclosed in the above patents. In the apparatus as disclosed herein the anode extensions are mounted separately and apart from the nozzles, each anode extension being associated with a corresponding nozzle. The anode extensions, however, enter the interior of the terminal from a different direction than that of the plating fluid. This improved apparatus permits a greater amount of plating solution to be flowed over the anode than is possible when the anode is contained within the nozzle. Further, this apparatus reduces the chances that any particulate matter will block the flow of the plating solution through the nozzle. Separating the anode extension and plating solution pathways also eliminates the possibility of particles becoming trapped between the anode and nozzle.

Since in the improved apparatus the anode extensions and plating fluid enter the terminal from different directions, closer tolerances can be maintained between the end of the anode extension and interior of the terminal.

The apparatus as disclosed herein is particularly adapted for plating strip fed terminals. The apparatus can also be used to plate loose piece terminals when used in conjunction with the loose piece plating apparatus disclosed in U.S. pat. application Ser. No. 564,279, now U.S. Pat. No. 4,473,445, filed Dec. 22, 1983, and owned by this assignee.

The apparatus in accordance with the invention is characterized in that a mandrel is rotated continuously as a strip of electrical terminals is fed continuously to the mandrel partially wrapped against the mandrel, and fed from the mandrel. The mandrel has a plurality of nozzles located around the mandrel's axis of rotation. The anode has a plurality of anode extensions which are associated with and aligned with but separate from said nozzles. The anode extensions are movable into and out of the interiors of the terminals that are against the mandrel. A conduit is provided which carries plating solution under pressure through the nozzles and upon the anode extensions. The nozzles inject plating solution into the interiors of the terminals in which the anode extensions have been received. A source of electrical potential supplies electrical current which flows from the anode extensions through the plating solution to the cathode, thus plating the interior surfaces of the terminals. The anode extensions are withdrawn from the interiors of the terminals as the terminals move out of the plating zone.

A better understanding of the invention is obtained by way of example from the following description and the accompanying drawings, wherein:

DESCRIPTION OF THE DRAWINGS

FIGS. 1, 2, and 3 illustrate a mandrel apparatus 1 according to one embodiment of the invention comprising an assembly of an insulative disc flange 2, a conductive anode plate 5, a conductive copper-graphite bushing 6, an insulated cam spacer means 84, an insulative cam 86, an insulative nozzle plate 4, an insulative wheel-shaped mandrel 3, and an insulative bearing case 54. In the preferred embodiment, bushing 6 is comprised of a first part 81 and a second part 83. First bushing part 81 is mounted to anode plate 5. Bushing retaining means holds 85 second bushing part 83 against bushing part 81 and shaft 9. The mating surfaces of parts 81 and 83 are designed to have a slight gap between them which is closed by retaining means 85. This ensures good electrical contact between bushing part 81 and 83 and with shaft 9. In the assembled unit, cam 86 is mounted to shaft 9. The remaining parts are assembled together with assembly means (not shown) and mounted for rotation on shaft 9. A continuous strip of electrical terminals 15, said terminals bein integral with and serially spaced along a carrier strip 16, is fed to the apparatus 1. The strip of terminals is partially wrapped against the mandrel 3 and fed from the mandrel.

FIG. 1 shows a series of radially projecting teeth 19 integral with and projecting from the alignment surface 18 on mandrel 3. The terminals 15 are nested in the spaces that form nests 20 between the teeth 19. FIG. 1 further shows a nozzle wheel 4 that is turreted with a plurality of radially spaced orifices or nozzles 26. Nozzles 26 communicate with and are at one end of electrolyte passageways 35. FIGS. 1 and 3 also show that the nozzles 26 are aligned with an open into the nests 20.

FIGS. 1 and 3 show a plurality of anode extensions 29 that are resiliently mounted for reciprocation into and out of the terminals 15 while the terminals are wrapped against the mandrel 3. A spring member 80 is associated with the anode extensions 29. FIGS. 1 and 3 also show a plurality of anode extension receiving openings 27 in anode plate 5 and a plurality of anode extension receiving openings 90 in nozzle plate 4.

FIGS. 1 and 3 further show that anode extensions 29 and their extension receiving openings are aligned with and associated with corresponding nozzles 26 and nests 20.

FIGS. 3, 4 and 5 show that the anode extension 29 is comprised of a conductive metal strip 60 and an insulated spreader body 62. The first end 66 of the body is shaped to spread apart and fit into terminals 15. The body has a collar 94 near its second end 93. Spring member 80 cooperates with body end 93. The body further has cam engaging means 95 intermittent its ends. The conductive metal strip 60 has a first end 96 which extends from the first body end 66, a middle portion 97 which lies within the body 62 and a second end 98 which exits the body 62 adjacent to and along one side of the collar 94.

FIGS. 1 and 3 show that flange 2 has an anode receiving channel 92 therein. The figures further show a plurality of radially spaced spring receptacles 82 within said channel 92. The receptacles 82 cooperate with spring members 80 as anode extensions 29 are advanced into and retracted from the terminals during the plating process.

As shown in FIGS. 3, 4 and 5 the anode extensions 29 are moved into and out of terminals 15 by means of lip 88 on cam 86. As the mandrel 3 rotates, the lip 88 engages the cam engaging means 95 on the anode extension spreader body 62, pushing the anode extension 29 into the anode receiving channel 92 and against the spring member 80. The strip of terminals 15 enter the mandrel 3 while the anodes are retracted. As the mandrel 3 rotates, the cam engaging means 95 is released from lip 88, the spring member 80 forces the anode extension 29 into terminal 15. As the anode extension moves into the terminal the conductive metal strip end 98 on body collar 94 engages anode plate 5. The anode extensions 29 are withdrawn from terminals 15 by interaction of the cam engaging means 95 and cam lip 88. As the anode extension 29 is retracted, metal strip 98 is disengaged from the anode plate 5. The strip of terminals 15 exit the mandrel apparatus 1 after the anode extensions 29 have been retracted.

FIGS. 1 and 3 show that conductive shaft 9 is provided with a central electrolyte conduit 36 extending along the length of its shaft. In the preferred embodiment, shaft 9 is designed so it can be mounted for either clockwise or counterclockwise rotation and for receiving electrolyte solution from either end of the shaft. End cap 10 seals the open end of the electrolyte conduit 36 that is not in use. A channel-shaped electrolyte outlet 68 is recessed in the cylindrical periphery of shaft 9. As mandrel 3 revolves about shaft 9, the nozzles 26 communicate with the electrolyte outlet 68 via electrolyte passageways 35, thus providing access of the electrolyte solution to terminals 15.

FIG. 3 shows schematically the mandrel apparatus, including a source E of electrical potential applied across the strip 16 and the conductive shaft 9.

In operation, driving means (not shown) rotate the mandrel apparatus 1 and feeding means (not shown) feed the strip terminals 15 onto the mandrel 3. Electrolyte 48 is supplied under pressure from the hose 49 into the conduit 36 of the shaft 9. An electrical potential from the source E is applied between the anode plate 5 and the strip fed terminals 15 to produce a current 1. The terminals 15 serve as a cathode onto which precious or semi-precious metal ions of the electrolyte 48 are to be plated. Upon rotation of the mandrel 3, each of the nozzles 26, in turn, will communicate via electrolyte passageways 35 with the electrolyte outlet 68. The electrolyte will flow under pressure into the electrolyte outlet 68, from there into several of the electrolyte passageways 35 that communicate with the electrolyte outlet 68. The electrolyte flows from the passageways 35 through the nozzle 26 and over the metal ends 96 of the anode extensions 29 which have been inserted into the interiors of the terminals 15. FIG. 6 shows an enlarged fragmentary view of the electrolyte flowing through the nozzle 26 and over the anode extension 29. The electrolyte wets the terminal interiors and the portion of the anode extensions which are in the terminal interiors. Sufficient ion density and current density are present for the ions to deposit as plating upon the surfaces of the terminal interiors. The proximity of the anode extension end 66 to the terminal interiors assures that the surfaces of the terminal interiors are plated rather than the other terminal surfaces. Excess electrolyte will flow past the anode extension and will be returned to the plating bath 47.

Figure 1:
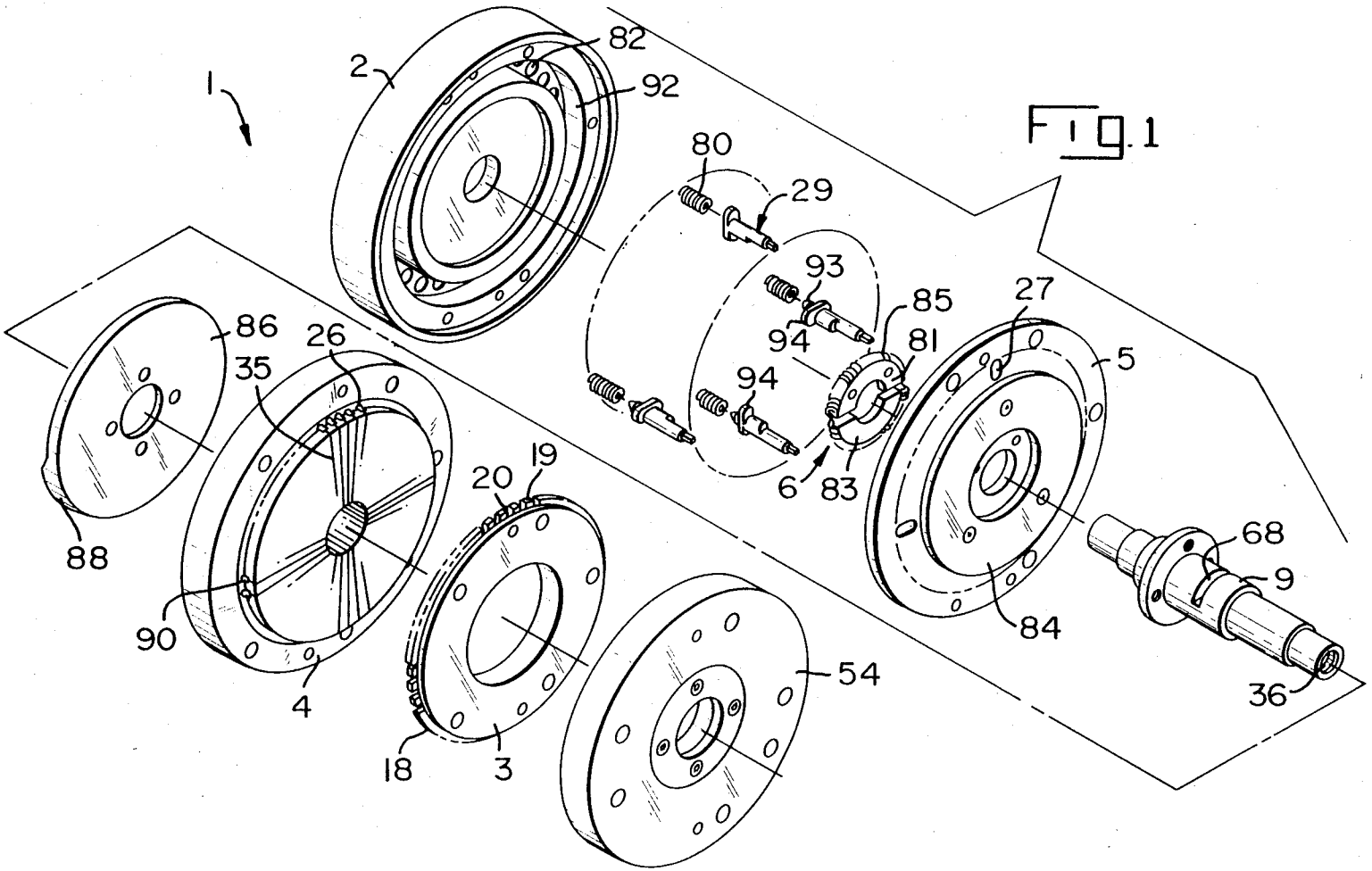
FIG. 1 is a perspective view of the apparatus for continuous plating according to the invention with parts of the apparatus exploded.
Figure 2:
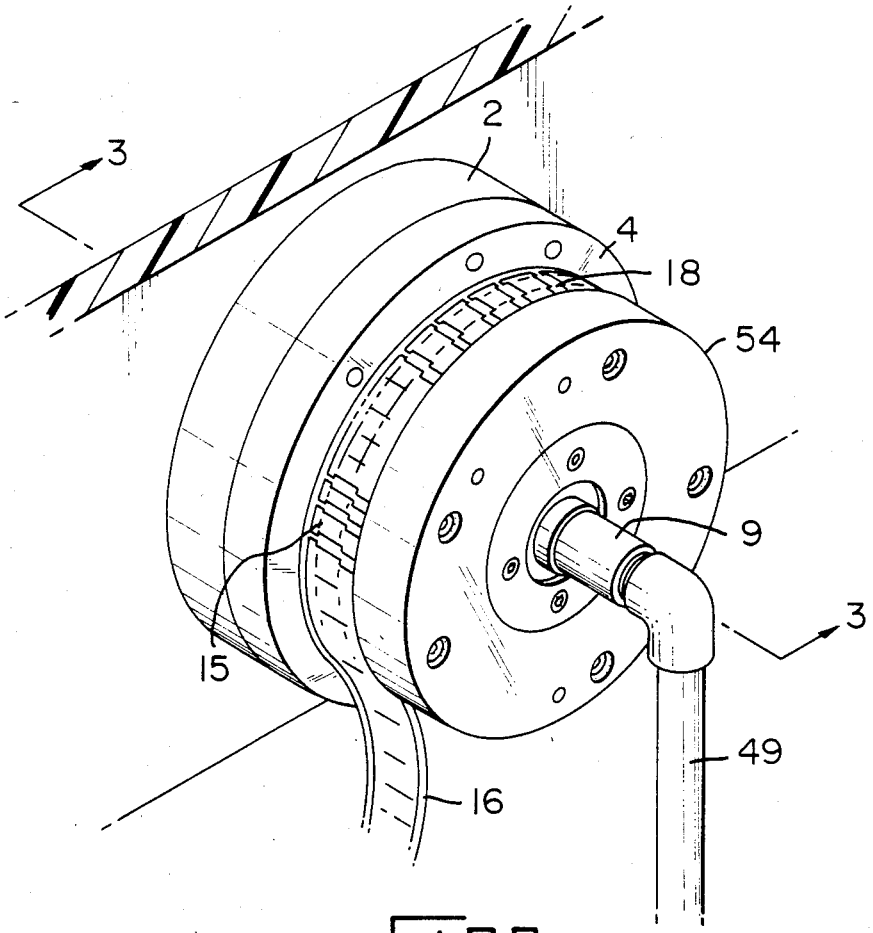
FIG. 2 is a perspective view of the apparatus shown in FIG. 1 with parts assembled.
Figure 3:
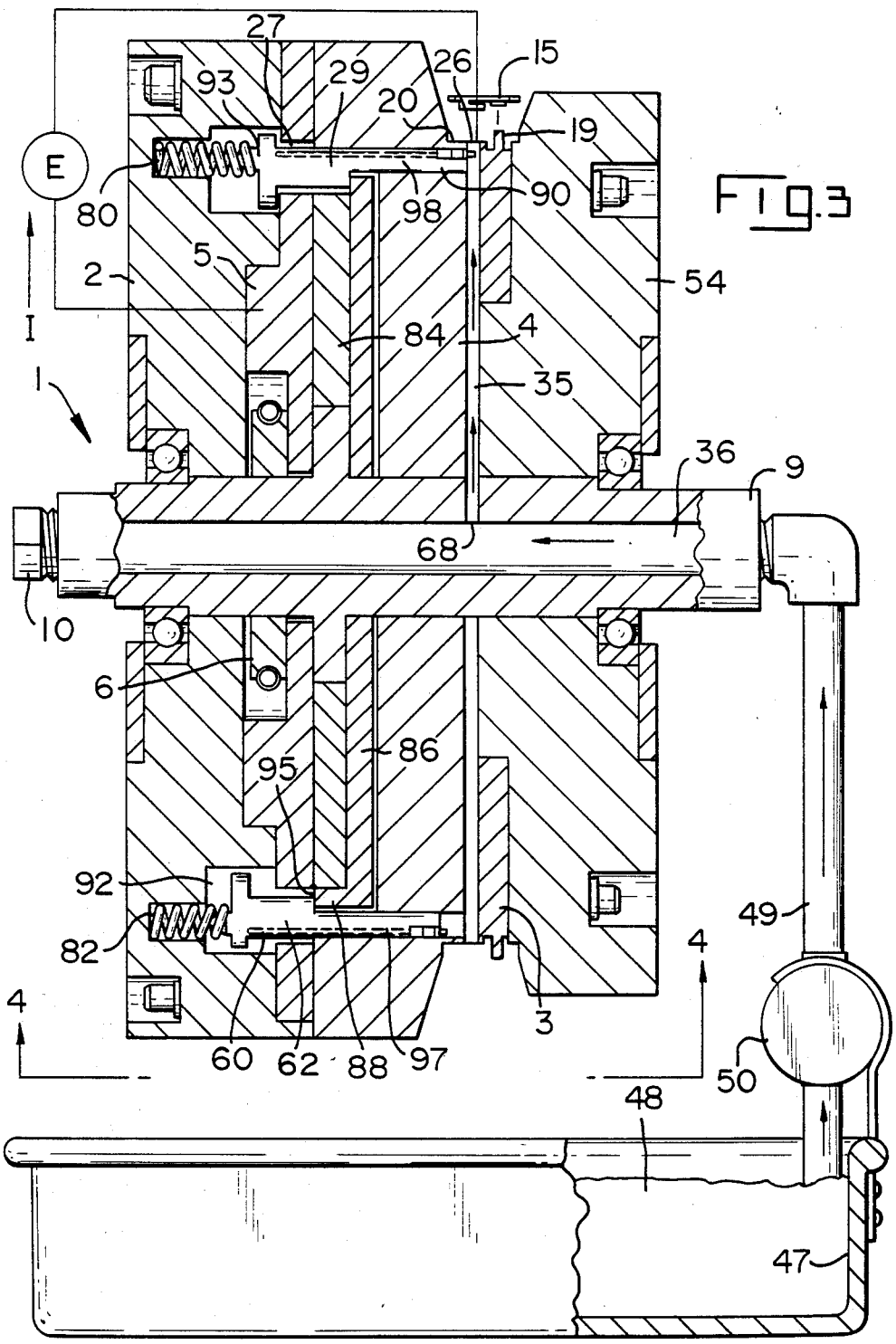
FIG. 3 is a view in section of a plating cell apparatus incorporating the apparatus and taken along the line 3—3 of FIG. 2.
Figure 4:
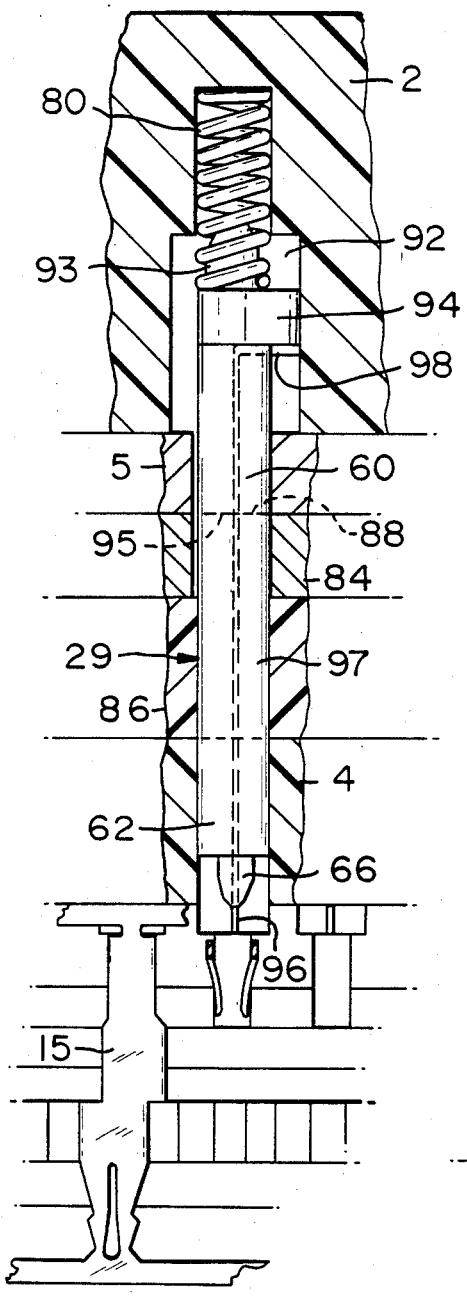
FIG. 4 is a fragmentary plan view, taken along the line 4—4 of FIG. 3 of a portion of the apparatus shown in FIG. 3 and illustrating a retracted anode extension.
Figure 5:
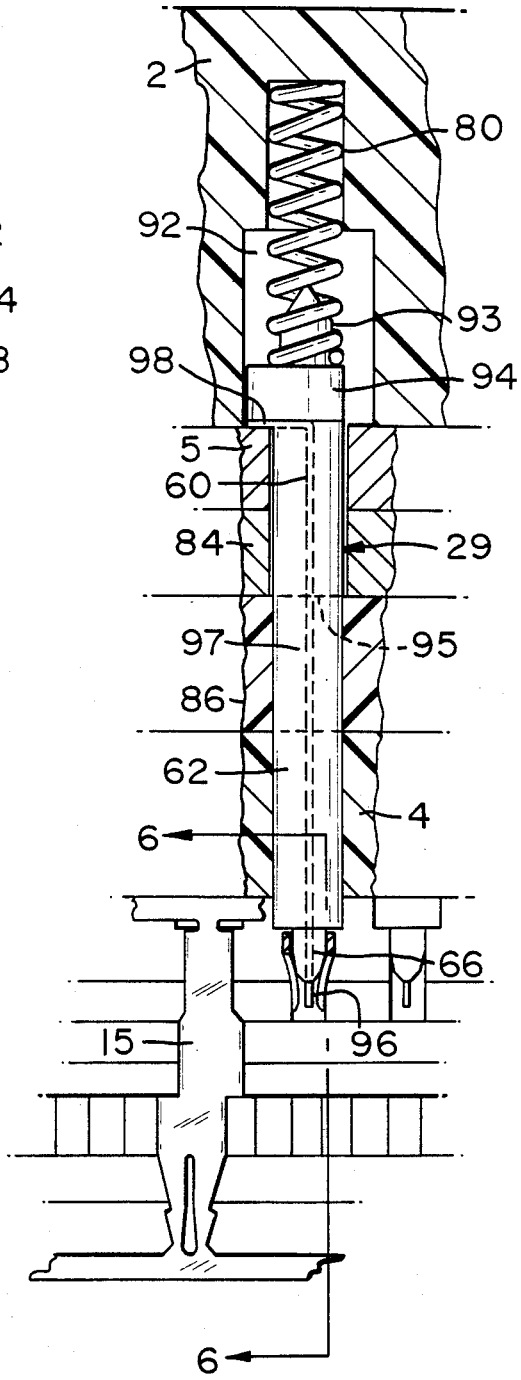
FIG. 5 is a view similar to FIG. 4, illustrating an advanced anode extension.
Figure 6:
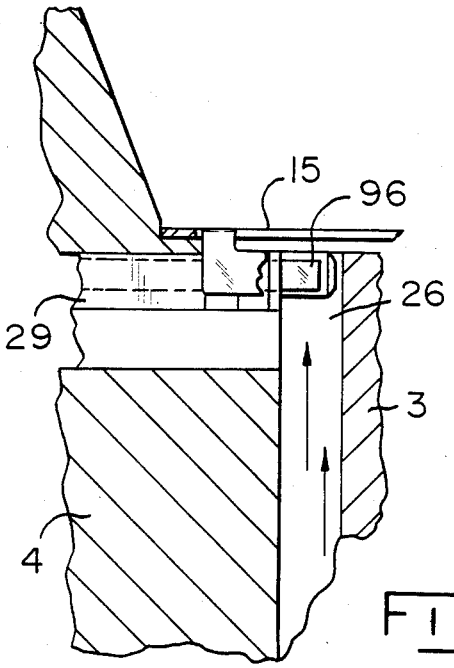
FIG. 6 is an enlarged fragmentary cross-sectional view taken along the line 6—6 of FIG. 5.

As the mandrel apparatus 1 is further rotated, the passageways become disconnected from the electrolyte outlet 68. The action of lip 88 on cam 86 causes the anode extension to withdraw from the interiors of the terminals 15, and plating deposition ceases. The terminals become removed from the mandrel apparatus 1 as the strip 16 continues to advance.

Figure 7:
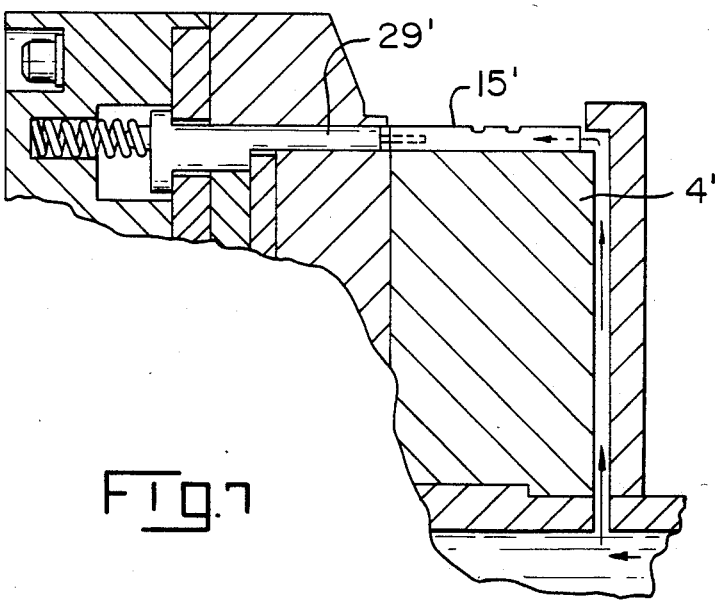
FIG. 7 is an enlarged fragmentary plan view of a portion of an alternative embodiment of the apparatus shown in FIG. 2.

FIG. 7 shows an alternative embodiment of the invention designed for barrel or sleeve type terminals 15'. In this embodiment, the nozzle plate 4' is designed so that the electrolyte flows into one end of the terminal 15' and the anode extension 29' is inserted into the opposite end of the terminal.

This invention has been described by way of examples only. Other forms of the invention having separate pathways for the plating solution and anode extensions are possible.

It is thought that the plating apparatus of the present invention and many of its attendant advantages will be understood from the foregoing description. It will be apparent that various changes may be made in the form, construction and arrangement of the parts thereof without departing from the spirit or scope of the invention or sacrificing all its material advantages. The receptacles 15 and 15' are only exemplary of the many forms of electrical receptacles, the internal surfaces of which are capable of being plated by the apparatus of the invention. The form herein described is merely a preferred or exemplary embodiment thereof.

What is claimed is:

1. An improved apparatus for plating interior surfaces of electrical terminals that are spaced apart and attached to a carrier strip comprising a strip feeding means for feeding the strip, a strip guide which guides the terminals through a plating zone while they are being plated, a source of electrolytic plating solution and a source of electrical potential for supplying an electrical current flow from an anode through the plating solution to a cathode, the strip guide being a mandrel that is continuously rotated as the strip of electrical terminals are continuously fed to the mandrel partially wrapped against the mandrel and fed from the mandrel, the improved apparatus being characterized in that the anode has a plurality of anode extensions which are located around the mandrel's axis of rotation, said anode extensions being movable into and out of the interiors of the terminals that are against the mandrel, the mandrel has a plurality of nozzles located around the mandrel's axis of rotation, said nozzles being associated with but separate from said anode extensions a conduit is provided which carries plating solution under pressure through the nozzles and upon the anode extensions, whereby the nozzles inject plating solution into the interiors of the terminals in which the anode extensions have been received, the electrical current flows from the anode extensions through the plating solution to the cathode, and the interior surfaces of the terminals are plated.

2. An apparatus recited in claim 1 characterized in that the mandrel is rotatably mounted on a shaft, the periphery of the shaft includes an inlet manifold that communicates with the conduit and the interior of the mandrel, the nozzles communicate with the interior of the mandrel and become in communication with the inlet manifold upon revolution of the mandrel interior about the shaft.

3. An apparatus as recited in claim 1 wherein a cam having a raised portion thereon moves the anode extensions into and out of said terminals.

4. An apparatus as recited in claim 1 wherein the anode extensions move within anode receiving openings and plating solution flows in electrolyte passageways, said openings and passageways being essentially normal to each other.

5. An apparatus as recited in claim 1 wherein the anode extension enters the terminal in a direction that is essentially parallel to the mandrel's axis of rotation and the plating solution enters the terminal from an electrolyte passageway that is essentially normal to the mandrel's axis of rotation.

6. An apparatus as recited in claim 1 wherein the anode extensions move within anode extension receiving openings and plating solution flows in electrolyte passageways, said openings and passageways being essentially coaxial with the direction of anode extension movement and plating solution flow being opposite each other.

7. An apparatus as recited in claim 1 wherein the anode extension enters the terminal in a direction that is essentially opposite to the direction of flow of the plating solution at the nozzle associated with said anode extension.

* * * * *